US011661318B2

(12) United States Patent
Woidneck et al.

(10) Patent No.: US 11,661,318 B2
(45) Date of Patent: May 30, 2023

(54) CONTROL SWITCH FOR OPERATING A HOIST OR CRANE

(71) Applicant: KONECRANES GLOBAL CORPORATION, Hyvinkää (FI)

(72) Inventors: Frederick Woidneck, Wetter (DE); Wolfgang Krebs, Wetter (DE); Giuliano Persico, Wetter (DE); Peter Kortmann, Wetter (DE)

(73) Assignee: Konecranes Global Corporation, Hyvinkää (FI)

( * ) Notice: Subject to any disclaimer, the term of this patent is extended or adjusted under 35 U.S.C. 154(b) by 0 days.

(21) Appl. No.: 17/753,806

(22) PCT Filed: Sep. 4, 2020

(86) PCT No.: PCT/EP2020/074758
§ 371 (c)(1),
(2) Date: Mar. 15, 2022

(87) PCT Pub. No.: WO2021/052780
PCT Pub. Date: Mar. 25, 2021

(65) Prior Publication Data

US 2022/0340397 A1 Oct. 27, 2022

(30) Foreign Application Priority Data

Sep. 19, 2019 (DE) ..... 10 2019 125 223.7

(51) Int. Cl.
*G05G 9/047* (2006.01)
*B66C 13/44* (2006.01)
*G05G 5/05* (2006.01)

(52) U.S. Cl.
CPC ..... *B66C 13/44* (2013.01); *G05G 5/05* (2013.01); *G05G 9/04788* (2013.01);
(Continued)

(58) Field of Classification Search
CPC ..... G05G 9/047; G05G 2009/04707; G05G 2009/04711; G05G 2009/04714;
(Continued)

(56) References Cited

U.S. PATENT DOCUMENTS 4,455,460 A * 6/1984 Bunnell ..... G05G 9/04788 200/6 A
5,293,900 A * 3/1994 Karbassi ..... B66C 13/56 345/161

(Continued)

FOREIGN PATENT DOCUMENTS

DE 19960757 A1 6/2000
EP 0898740 A1 3/1999
EP 2642365 A1 9/2013

OTHER PUBLICATIONS

International Search Report and Written Opinion from corresponding international Application No. PCT/EP2020/074758, completed Nov. 17, 2020.

(Continued)

*Primary Examiner* — Brian J McGovern
(74) *Attorney, Agent, or Firm* — Gardner, Linn, Burkhart & Ondersma LLP

(57) ABSTRACT

A control switch for operating, preferably in single-hand operation, a hoist or crane, having a device for manual actuation, preferably single-finger actuation, with a base element, which is preferably designed as a housing, and a control lever which can be pivoted relative to the base element and which can be pivoted by means of a pivot movement triggered by means of manual actuation, preferably single-finger actuation, from an unpivoted base position into an actuation position that is pivoted in relation to the base position, in order thereby to bring about a predefined movement of the hoist or crane.

18 Claims, 9 Drawing Sheets

(52) U.S. Cl.
CPC ..... *G05G 2009/04718* (2013.01); *G05G 2009/04774* (2013.01); *G05G 2505/00* (2013.01)

(58) Field of Classification Search
CPC ..... G05G 2009/04733; G05G 2009/04766; H01H 25/04
See application file for complete search history.

(56) References Cited

U.S. PATENT DOCUMENTS 5,432,530 A * 7/1995 Arita ..... G06F 3/0338 345/159
9,540,216 B2 * 1/2017 Paßmann ..... E04C 3/09
2002/0043510 A1 * 4/2002 Bachman ..... B66C 13/40 212/283
2006/0191775 A1 8/2006 Edmunds
2007/0262959 A1 * 11/2007 Gu ..... G05G 9/047 345/161
2011/0148667 A1 * 6/2011 Yeh ..... G05G 9/047 341/20
2013/0247702 A1 * 9/2013 Etxegarai Martinez ..... G05G 1/04 74/471 XY
2015/0266703 A1 * 9/2015 Pa mann ..... B66C 6/00 212/71
2016/0077543 A1 * 3/2016 Conro ..... G05G 9/047 74/471 XY
2016/0236914 A1 * 8/2016 Persico ..... B66C 13/40
2017/0144867 A1 * 5/2017 Paßmann ..... F16B 7/18
2018/0237274 A1 * 8/2018 Rantala ..... B66C 13/40
2019/0375616 A1 * 12/2019 Zhao ..... B66C 13/44

OTHER PUBLICATIONS

International Preliminary Report on Patentability from corresponding international Application No. PCT/EP2020/074758, completed Nov. 23, 2021.
Demag Cranes and Components: "DRC MJ mini joystick", Corresponding to D8 from the International Preliminary Report on Patentability, dated Aug. 31, 2017, retrieved from URL https://dds.demagcranes.com/DDS/getPDF/21381344_EN-DE.pdf.

* cited by examiner

CONTROL SWITCH FOR OPERATING A HOIST OR CRANE

The invention relates to a control switch for operating, preferably in single-hand operation, a hoist or crane, comprising a device for manual actuation, preferably single-finger actuation, with a base element, which is preferably designed as a housing, and a control lever which can be pivoted relative to the base element and which can be pivoted by means of a pivot movement triggered by means of manual actuation, preferably single-finger actuation, from an unpivoted base position into an actuation position that is pivoted in relation to the base position, in order thereby to bring about a predefined movement of the hoist or crane, wherein the control switch is designed as a wired pendant control switch or as a hand-held radio transmitter, comprising a manually actuable control element in the form of a pushbutton or of another non-pivotable control element for controlling further functions of the hoist or crane.

Such control switches are used to trigger crane movements, such as crane and trolley travel or lifting and lowering, by manual actuation, in particular by thumb actuation, of the device. In this context, corresponding devices are also referred to as a joystick or a mini-joystick on account of the possibility of a single-finger actuation by a finger, placed on the control lever, of the hand holding the control switch. Control switches of this type are sold, for example, by the Konecranes Global Corporation and Demag Cranes & Components GmbH companies; see, for example, www.demagcranes.de/produkte/komponenten/steuerschalter-und-drahtlose-steuerungen/drc-mj-mini-joystick.

The use of joysticks as control devices for operating machines is known from EP 2 642 365 A1, EP 0 898 740 A1, DE 199 60 757 A1, US 2006/191775 A1, US 2016/077543 A1 and also from US 2011/148667 A1.

The object of the invention is to provide an improved generic control switch for operating, preferably in single-hand operation, a hoist or crane, which can be manufactured more economically in various variants for different applications and can be repaired particularly easily in the event of wear.

This object is achieved by a control switch having the features of Claim 1. Advantageous embodiments of the invention are given in the dependent claims and the following description.

A generic control switch for operating, preferably in single-hand operation, a hoist or crane, comprising a device for manual actuation, preferably single-finger actuation, with a base element and a control lever which can be pivoted relative to the base element and which can be pivoted by means of a pivot movement triggered by means of manual actuation, preferably single-finger actuation, from an unpivoted base position into an actuation position pivoted in relation to the base position, in order thereby to bring about a predefined movement of the hoist or crane, wherein the control switch is designed as a wired pendant control switch or as a hand-held wireless transmitter, comprising a manually actuable control element in the form of a pushbutton or another non-pivotable control element for controlling other functions of the hoist or crane, said control switch being producible according to the invention more economically in different variants for different applications particularly easily and being repairable particularly easily in the event of wear; that due to its shape, a shifting gate influences the pivot movement of the control lever and that the shifting gate is detachably connected to the base element and thus in particular detachably fastened to the base element, the device having a sensor system for detecting the pivot movement, preferably a pivot direction and/or a pivot angle of the control lever, wherein the sensor system is designed to detect the pivot movement contactlessly.

The manual actuation of the device is preferably a single-finger actuation. The pivot movement of the control lever is here caused by means of manual actuation, preferably single-finger actuation, preferably thumb actuation, of an operator. The device can therefore be installed in the control switch, for example as part of a mini-joystick, in such a way that, by means of a finger, preferably a thumb, placed on the control lever, in particular a finger or thumb of the hand holding the control switch, an operator manually actuates the control lever and thus the device by means of a single-finger actuation in order to bring about a movement of the hoist or crane.

The movements of the hoist or crane which can be brought about by actuation of the device, in particular of the control lever, are unambiguously assigned to the pivot movement in particular with regard to its pivot direction and its pivot angle. In the case of a stationary hoist, this can be, for example, a lifting or lowering movement and, in the case of a crane, for example, in addition to the vertical lifting or lowering movement, horizontal crane and trolley travel as well. In the usual manner, it is provided that no movement of the hoist or crane is brought about when the control lever is in the unpivoted base position. The control signals required for a movement of the hoist or crane are thus only generated, output to a controller of the hoist or crane and/or processed by the controller when the control lever is in an actuation position but not when the control lever is in the base position.

The control switch can also have one or more manually actuable control elements for controlling further functions of the hoist or crane, for example pushbuttons or other non-pivotable control elements. Of course, control switches are also conceivable in which more than one device according to the invention is installed. For the operation of a crane, one device can, for example, be provided for the lifting and lowering movements and a further device for the horizontal crane movements of the crane girder (crane travel) and of the crane trolley carrying the hoist (trolley travel).

With regard to the hoists or cranes to be operated, various hoist and crane types are conceivable.

As a result of the detachable connection of the shifting gate and the exchangeability achieved thereby, the shifting gate is thus designed as a modular and separate replacement part. The shifting gate is thus not an integral component of the base element, which can consequently have its own function independent of the shifting gate. If the base element is a housing, its enclosure function, for example for a sensor system for detecting a pivot movement of the control lever, in particular, a pivot direction and/or a pivot angle, in particular including the magnitude of the pivot angle, remains independent of the function of the shifting gate due to the detachable connection.

This makes it particularly easy to realize variants of the device with different shifting gates for different applications of the device, for example the variants shown in FIGS. 4*a* to 4*d*. For this purpose, only the shape of the shifting gate needs to be varied, but the base element with its respective other function of its own can likewise remain the same like the control lever. This advantageously increases the usability of identical parts for the respective variants of the device and thus of the control switches. Repairs in the event of wear of the shifting gate are also considerably simplified since due to structural separation of function, only the shifting gate needs to be replaced.

In other words, the shifting gate designed according to the invention as a detachable replacement part has mainly or preferably, even exclusively, the function of influencing the pivot movement of the control lever in a manner predefined by a corresponding shape of the shifting gate. The function of the shifting gate is thereby separated from other components and their functions, in particular from the enclosure function of the housing.

The device can also have a sensor system for detecting the pivot movement of the control lever, preferably including or in the form of a pivot direction and/or a pivot angle, in particular including the magnitude of the pivot angle. By means of the pivot movement or corresponding actuation position detected by the sensor system, a conversion into control signals can subsequently take place, which, in the case of a signal-transmitting connection with the controller of the hoist or crane, bring about a predefined movement of the hoist or crane assigned to the respective actuation position or the associated pivot direction and/or the associated pivot angle in particular with respect to direction and/or speed. The sensor system is preferably accommodated in the housing of the device and can be connected to the controller of the hoist or crane in a signal-transmitting manner.

The sensor system is advantageously designed to detect the pivot movement contactlessly, preferably according to a magnetic operating principle. A contactless sensor system has the advantage that it is particularly low-wear or even wear-free.

It is advantageously provided that the sensor system has a magnet and a Hall sensor, preferably a 3D Hall sensor, which interacts with the magnet. The magnet is preferably fastened to the control lever or integrated into the control lever and the Hall sensor is preferably fastened to the housing.

An electrical circuit board for generating the control signals can likewise be arranged in the housing and in a signal-transmitting manner connected to the sensor system and to the controller of the hoist or crane arranged outside the device and possibly outside the control switch. However, it is also conceivable for the control signals to be generated outside the housing of the device. For safety reasons, a dead-man circuit can additionally be provided so that an unintentional pivoting of the control lever alone does not trigger any movement of the hoist or crane, unless this is released by the dead-man circuit. Also conceivable are structural measures, such as at least one rib-shaped protective fin which surrounds the control lever at least in sections in order to prevent its unintentional pivoting. The protective fin(s) can project, for example, from the housing.

The control switch can be designed as a wired pendant control switch or as a hand-held wireless transmitter, for example as a hand-held radio transmitter. Alternatively, the control switch can also be installed in an armrest of a crane operator's seat, wherein a single-finger actuation is then also possible. Of course, more than one device for manual actuation, preferably single-finger actuation, can also be installed here.

In a constructively simple manner, it can be provided for the control lever to be pretensioned in relation to the base element, preferably by means of a spring element, and in an unactuated state be held in the unpivoted base position by a pretensioning force, and be pivotable against the pretensioning force into the pivoted actuation position by means of a force applied by manual actuation, preferably by single-finger actuation. In terms of force flow, the spring element is preferably arranged between the shifting gate and the control lever.

The pretension thus serves to satisfy safety requirements since it brings about an automatic pivot movement of the control lever back into the unpivoted base position as soon as manual actuation of the control lever is finished. The spring element acting indirectly or directly on the control lever can be supported on the base element, i.e., for example, on the housing or on another element of the device which is rigidly connected thereto, in order to achieve the pretension. In this case, the spring element can be a helical spring which extends, at least in the base position, in parallel to, preferably coaxially with, the control lever and in this case inside or outside the control lever.

In addition, for the shape-related influencing of the pivot movement of the control lever by the shifting gate, it can be provided that a guide element, which is preferably frame-shaped or is ring-shaped when the frame is closed, be attached to the control lever in such a way that the control lever is supported on the shifting gate by means of the guide element and the guide element be guided along a characteristic contour of the shifting gate during the pivot movement of the control lever and at the same time, in particular dependent on the pivot direction and/or the pivot angle of the control lever, be moved relative to the control lever, in particular counter to or in the direction of the pretensioning force and preferably in parallel to the longitudinal axis of the control lever, in order to define a shifting characteristic of the device.

Here, in particular due to its characteristic contour, as a shape-related influence for some or all of the possible pivot movements of the control lever, the shifting gate can define an actuating force which is to be applied by means of manual actuation in order to bring the control lever into a possible pivoted actuation position. The respective actuating force, which is thus also defined as a restriction of the pivot movement in terms of force, is here in particular dependent on the associated pivot direction and/or the associated pivot angle in relation to the base position.

The characteristic contour can therefore also be referred to as a guide face for the control lever and/or the guide element. The characteristic contour or guide face is located, in particular, as a profiled surface on the side of the shifting gate facing the guide element and can have, in the radial direction, i.e., as seen from the central axis of the shifting gate radially outward, a surface profile which initially rises from the inside to the outside in a ramp-like manner and then falls. Such a change of a ramp-like rising and subsequently falling surface profile can be repeated radially outward, which can result in more than one maximum of the surface profile. However, the surface profile preferably always falls toward the outer edge of the shifting gate. Here, linear, degressive or convex or concave surface profiles or any combinations of these surface profiles in the radial direction on a section-by-section basis are in each case possible. An edge can also be formed between two sections or surface profiles of the characteristic contour which are adjacent in the radial direction and have different slopes. Several edges are also possible in the radial direction.

When the control lever is pivoted starting from the base position, in all variants of the shifting gate, the guide element is guided radially outward starting from the innermost section of the respective characteristic contour and is here supported on the characteristic contour.

If the guide element is designed as a frame or in the case of a closed frame as a ring, the control lever preferably extends through an opening bounded by the frame or ring. Here, the opening of the guide element and the longitudinal extension of the control lever are coaxial with one another at least in the base position and preferably also in the actuation position. Here, the opening and/or the outer contour of the guide element can be round, preferably circular, and the opening can be formed by an annular and/or cylindrical and thus sleeve-shaped section of the guide element.

The surface profile of the characteristic contour of the shifting gate can be designed such that, in the case of a pivot movement of the control lever starting from the base position, as the pivot angle increases, the movement of the guide element takes place alternately counter to and in the direction of the pretensioning force, in particular in parallel to the longitudinal axis of the control lever. As a result, due to the shape of the shifting gate, in particular of the characteristic contour, a resulting force acting on the control lever is thus produced, which exceeds the pretensioning force in a manner dependent on the pivot angle and to a varying extent. This is accompanied by correspondingly changing holding forces or actuating forces, which are to be applied by an operator when setting the respective pivot directions and pivot angles in order to bring about the assigned movement of the hoist or crane, in particular the direction and/or speed thereof. The guide element must preferably first be moved against the pretensioning force so that the required actuating force initially rises starting from the base position and the associated pretensioning force. Here, depending on the desired shifting characteristic, different surface profiles of the characteristic contour are conceivable for different shifting gates and can rise in the radial direction from the inside to the outside, for example, in a ramp-like manner with a preferably linear or degressive or convex surface profile.

For a continuous shifting characteristic, the slope of the ramp-like surface profile is preferably less than for a stepped shifting characteristic so that in the case of a stepped, for example a single-step, shifting characteristic, the first or only maximum of the surface profile of the characteristic contour lies further inward in the radial direction and is thus reached with a smaller pivot angle than in the case of the continuous shifting characteristic.

Optionally, in all variants of the shifting gate, in particular both in the case of the continuous variants described below and in the case of the stepped variants, a kind of start detent can be realized. In this case, it is then provided that a predefined resistance in the sense of a minimum actuating force must first be overcome in order to pivot the control lever initially over a minimum pivot angle so far out of the base position that a control signal is generated or output, and that for further pivoting of the control lever up to the first or only maximum, a smaller increase of the actuating force is required than for the initial pivoting over the minimum pivot angle. If the minimum actuating force or the minimum pivot angle is undershot, the control lever is not pivoted or not pivoted sufficiently and a control signal is consequently also not generated or output. In order to realize such a start detent, it can be provided for the surface profile of the characteristic contour, which rises in the radial direction outward in a ramp-like manner, to have an inner first section with a significantly greater slope than the second section adjoining radially outside. As a result, the further pivoting of the control lever and the movement of the guide element in the second section brought about thereby requires a smaller increase of the required actuating force perceptible during manual actuation than the initial pivoting of the control lever and movement of the guide element over the first section. An edge can be formed between the two sections, as a result of which exceeding the minimum actuating force or the minimum pivot angle can be felt particularly clearly.

Upon the first maximum of the surface profile or of the corresponding actuating force being reached, said force can decrease again as the pivot angle increases until an end position, for example a structurally related end position, with a maximum possible pivot angle is reached. Accordingly, the guide element then moves in the direction of the pretensioning force. Alternatively, in the case of a pivot angle increasing further after the first maximum, a pivot angle range with a once again rising surface profile and with increasing actuating force up to a second maximum and a corresponding movement of the guide element counter to the pretensioning force can follow, in particular in order to realize the multi-step shifting characteristic described in more detail below. More than two maxima of the surface profile and of the corresponding actuating force are also conceivable over the entire pivot angle range. Due to the drop in the surface profile following the respective maximum, the actuating force required to hold the shifting step or end position is reduced on the one hand and there is a hysteresis on the other hand in the case of the pretension-related return of the control lever to its base position after manual actuation has ended.

It can be provided in a structurally simple manner for the spring element to be arranged between the optional guide element and the control lever in terms of force flow. In other words, the pretensioning force acting on the control lever via the spring element is thus applied indirectly with the guide element being interposed in terms of force flow between the base element and the spring element, preferably between the shifting gate and the spring element. The actuating force defined as a shape-related influence as well as a force-related restriction of the pivot movement of the control lever is also dependent in particular on the associated pivot angle in relation to the base position. The pivot angle of the control lever influences where the guide element is supported on the shifting gate or on the characteristic contour, and thus the relative position of the guide element on the control lever, which in turn influences the force acting in the spring element and thus the actuating force to be applied.

A recess, in which the spring element can be supported on the guide element, can also be provided on the guide element. If the spring element is a helical spring, it can be provided that the guide element be frame-shaped or ring-shaped and preferably have an annular section and an adjoining cylindrical section, via which the spring element can then be plugged together with the guide element. The optional recess can then likewise be frame-shaped or ring-shaped and be arranged between the cylindrical section and the outer contour of the guide element. For example, the spring element can then be plugged onto the outside of the cylindrical section of the guide element. This applies regardless of the arrangement of the control lever relative to the helical spring. Optionally, an actuating element described in more detail below can also be arranged between the spring element and the control lever in terms of force flow, as a result of which the pretensioning force is applied by the spring element to the control lever via the actuating element. The spring element is then arranged in terms of force flow between the shifting gate and the optional actuating element, preferably between the optional guide element and the optional actuating element. The spring element can thus be supported at one end on the control lever via the optional actuating element and at another end on the base element via the optional guide element and the shifting gate in order to achieve the pretension in the base position.

In one possible embodiment, it can be provided that the shifting gate be formed in a frame-like manner or, in the case of a closed frame, in a ring shape and for the control lever to extend through an opening in the shifting gate. The shifting gate is then preferably formed by a ring element on which the characteristic contour is formed. In the base position, the central axis of the shifting gate is preferably coaxial with the longitudinal axis of the control lever. Here, the opening and/or the outer contour of the shifting gate can be round, preferably circular. The control lever preferably also extends through a housing opening into the housing in order to ensure a reliable interaction with the switching means, in particular with the above-mentioned sensor system, which then can detect within the housing the pivot movements or the actuation positions set therewith, as well as the associated pivot directions and pivot angles.

Here, the characteristic contour is arranged in the circumferential direction in sections or fully around the opening of the shifting gate and the control lever. Particularly preferred is an embodiment of the shifting gate such that the characteristic contour extends around the opening of the shifting gate in the shape of a circular ring segment or of a circular ring. In the base position of the control lever, the control lever is then formed coaxially with the shifting gate and its characteristic contour. By designing the characteristic contour in sections, in particular in the form of circular ring segments, it is possible, for example, to define preferred directions described in more detail below, whereas in the case of a fully circumferential characteristic contour, no preferred direction is defined so that the same actuating force has to be applied for all pivot directions with the same pivot angle magnitude.

It can advantageously be provided that the characteristic contour of the shifting gate be designed such that a continuous or stepped, in particular single-step or multi-step, shifting characteristic of the device results.

In the continuous variant, a continuously or constantly increasing or decreasing pivot angle profile via correspondingly assigned control signals brings about a continuously or constantly increasing or decreasing speed profile of the movement of the hoist or crane in the respective movement direction. If a start detent is realized, this applies only after the minimum actuating force or the minimum pivot angle is exceeded.

In contrast, in the case of the stepped variant, a maximum in the surface profile of the characteristic contour and thereby a pivot angle range is defined for each shifting step, to which is assigned a speed of movement of the hoist or crane that differs from zero. In order to activate the respective shifting step, reaching or exceeding predefined pivot angles of the control lever or of the respective maxima is necessary to trigger the respectively assigned speed of movement of the hoist or crane and output corresponding control signals. Before activation of the first step, it is necessary here to reach a minimum pivot angle, where applicable after overcoming the optional start detent, since in a lower pivot angle range, no movement of the hoist or crane is brought about or no corresponding control signal is triggered or processed. In the case of a multi-step shifting characteristic, a correspondingly larger pivot angle must accordingly be reached for the next higher speed since in the case of a pivot angle lying between two pivot angle thresholds, the speed of the lower shifting step is otherwise maintained at lower speed or a speed of zero.

In the case of a pretensioned control lever, the pivot movements and associated pivot angles thereof are, as described above, accompanied by corresponding movements of the guide element and by associated actuating forces which are to be applied during manual actuation, in particular single-finger actuation, in order to move the control lever into the possible pivoted actuation position(s) or shifting steps. The above-described surface profiles of the characteristic contours and the associated pivot-direction-dependent and pivot-angle-dependent actuating forces, in particular the noticeable fall or smaller increase in the actuating force of a further pivoted control lever after reaching a maximum or an edge, serve for the operator as clearly perceptible tactile feedback during manual actuation. In the case of the stepped variant, reaching shifting steps in the case of manual actuation is thus perceptible; in the case of the continuous variant, reaching the maximum speed is thus perceptible; and in the case of the optional start detent, reaching the second outer section of the surface profile rising in the shape of a ramp is thus perceptible.

The shape-related influence brought about by the shifting gate or its characteristic contour and the associated force restriction of the possible pivot movements thus also relates to the actuating forces which are to be applied for manual actuation, in particular single-finger actuation, and counteract the pretensioning force of the control lever in order to move the control lever in particular from the unactuated base position into the possible actuation position(s) or shifting steps.

Accordingly, depending on the shifting gate and associated characteristic contour used, different, in particular continuous or stepped, movements of the guide element and resulting courses of actuating forces are possible for manual actuation, in particular single-finger actuation, of the control lever and its pivot directions and pivot angles set therewith.

Advantageously, for the shape-related influencing of the pivot movement of the control lever by the shifting gate, it can be provided that the shifting gate be designed such that the pivot movement of the control lever is limited to a uniaxial or a multiaxial pivot movement, wherein in the case of a frame-shaped shifting gate, the shape of the opening of the shifting gate is preferably designed in such a way that the uniaxial or multiaxial limitation of the pivot movement results.

In this case, the shifting gate, as a shape-related influencing of the possible pivot movements in the sense of a spatial restriction for the possible pivot movements of the control lever, can define a guide as a pivot range restriction.

In the uniaxial variant, a pivot range is defined by the shifting gate, in particular by its opening, and spatially limits the possible pivot movements of the control lever to pivot movements about exactly one axis. In the case of a frame-shaped or ring-shaped shifting gate, the opening is then elongate with two parallel and linear edges. In the multiaxial variant, on the other hand, a pivot range is defined by the shifting gate, in particular by its opening, and allows pivot movements about a plurality of notional or virtual axes, preferably at least two axes arranged perpendicularly to one another, or overlappings thereof as spherical pivot movements in the sense of free, three-dimensional pivoting, for example in order to bring about a superimposed movement of the hoist or crane, in particular a diagonal travel of a crane trolley. In order to allow spherical pivot movements, the opening is round, preferably circular. As a result, the control lever can in principle be mounted, for example by means of a ball joint, so as to be freely and three-dimensionally pivotable. The pivot range or the entirety of pivot movements possible therein, in particular pivot angles, is then influenced and correspondingly limited by the shape of the shifting gate, in particular its opening, and thus in a shape-related manner.

Corresponding to the pivot movements possible by the choice of the shifting gate, in particular pivot directions and/or pivot angles, the movements of the hoist or crane that can be brought about by means of the device, in particular the associated pivot directions, can be unambiguously assigned thereto and thus defined as one-dimensional or multi-dimensional.

If spherical pivot movements are allowed, in particular by a corresponding opening of the shifting gate, pivot movements about two notional or virtual main axes perpendicular to one another can be defined as preferred directions for the movement of the hoist or crane, for example for the travel of a crane trolley in mutually perpendicular X and Y directions. By the corresponding shaping of the shifting gate, in particular the characteristic contour, a deviating, preferably higher, necessary actuating force can be defined for a pivot movement deviating from the preferred directions than the actuating force required for a pivot movement in one of the preferred directions with the same pivot angle magnitude. Accordingly, a higher actuating force on the control lever can be required in order to bring about a superimposed movement of the hoist or crane, such as the diagonal travel of a crane trolley mentioned by way of example, than for bringing about a movement of the hoist or crane in one of the preferred directions, i.e., for example, travel of the crane trolley only in the X direction or only in the Y direction.

In order to define such preferred directions, it can be provided, for example, that the characteristic contour in the circumferential direction has a surface profile in sections, in particular in the shape of circular ring segments. Between the individual sections or segments, the surface of the shifting gate then stands so far back in relation to the characteristic contour in the sense of a recess that the guide element between the segments cannot be supported on the shifting gate. In the region of the recesses, the shifting gate can have a planar surface facing in the axial direction, which surface is correspondingly set back in relation to the segments of the characteristic contour. In other words, the characteristic contour is thus interrupted in sections in the circumferential direction. The preferred directions run, preferably centrally, through the recesses lying between the interrupted sections of the characteristic contour. The recesses can also be in the shape of circular ring segments. Four identically designed sections of the characteristic contour are preferably formed in the circumferential direction, which sections are interrupted or separated from one another by a total of four recesses.

The design of the shifting gate with respect to the definition of the desired pivot range of the control lever is independent of the characteristic contour so that any combinations amongst them are possible. In particular, the aforementioned preferred directions can thus be realized equally in the case of a continuous or stepped characteristic contour of the shifting gate.

Particularly simple fastening of the shifting gate to the base element can be achieved by the shifting gate being detachably connected to the base element via a positive-locking connection, preferably having at least one detent lug, and is thereby fastened, in particular detachably to the base element. The respective detent lug is preferably part of the shifting gate, in particular of its ring element, and the receptacle(s) for the detent lug(s) associated with the production of the positive-locking connection is/are preferably part of the base element, although a reverse arrangement of the detent lug(s) and receptacle(s) is also possible. If the base element is a housing, the characteristic contour of the shifting gate is preferably arranged on a side of the shifting gate facing away from the housing.

Accordingly, the means, designed for example as detent lugs, for producing the positive-locking and detachable connection in the case of a released shifting gate and the characteristic contour provided for restricting the pivot movements are located on opposite sides or on sides facing away from one another of the preferably frame-shaped shifting gate. The positive-locking connection can also be designed as a snap-in connection via the detent lug(s).

A simple assembly of the device can be achieved in that at least one receptacle for producing the positive-locking connection is provided on a side of the base element facing the shifting gate. The positioning of the shifting gate within the device and relative to its movable components, in particular to the control lever, can be defined particularly easily by the position of the receptacle(s). This applies in particular in the case of a positive-locking connection produced by means of detent lug(s), namely even when the detent lug(s) are arranged on the base element and the receptacle(s) are arranged on the shifting gate and are in each case preferably a part thereof. The at least one receptacle for producing the positive-locking connection and the means for producing the positive-locking and detachable connection are preferably the same in all variants of the shifting gate. The different variants of the shifting gates thus differ only by the respective characteristic contour and/or their openings for defining the desired pivot range (uniaxial or multiaxial) of the control lever.

The embodiments of the device described in each case in the context of this document can also have an actuating element which is mounted on the control lever and defines the direct contact surface of the actuating hand or the actuating finger of the operator. In order to improve ergonomics in the sense of a simple and intuitive operation for the operator for the respective application of the device, different actuating elements with different contact surface contours are conceivable, for example concave contours for receiving a fingertip and/or projecting touch lugs, which represent the respective movement directions of the hoist or crane, in particular the possible preferred directions.

For protection against environmental influences, the device can also have an elastic protective cover which is fastened to the base element and surrounds the shifting gate and at least in sections the control lever, in particular, in the case of a base element designed as a housing, the part of the control lever projecting from the housing as well as the optional components, i.e., the guide element and spring element. Here, the protective cover seals the opening provided for passage of the control lever in the housing and thus also protects against environmental influences the components of the device arranged within the housing.

An exemplary embodiment of the invention is explained in more detail with reference to the following description. The following are shown:

Figure 1:
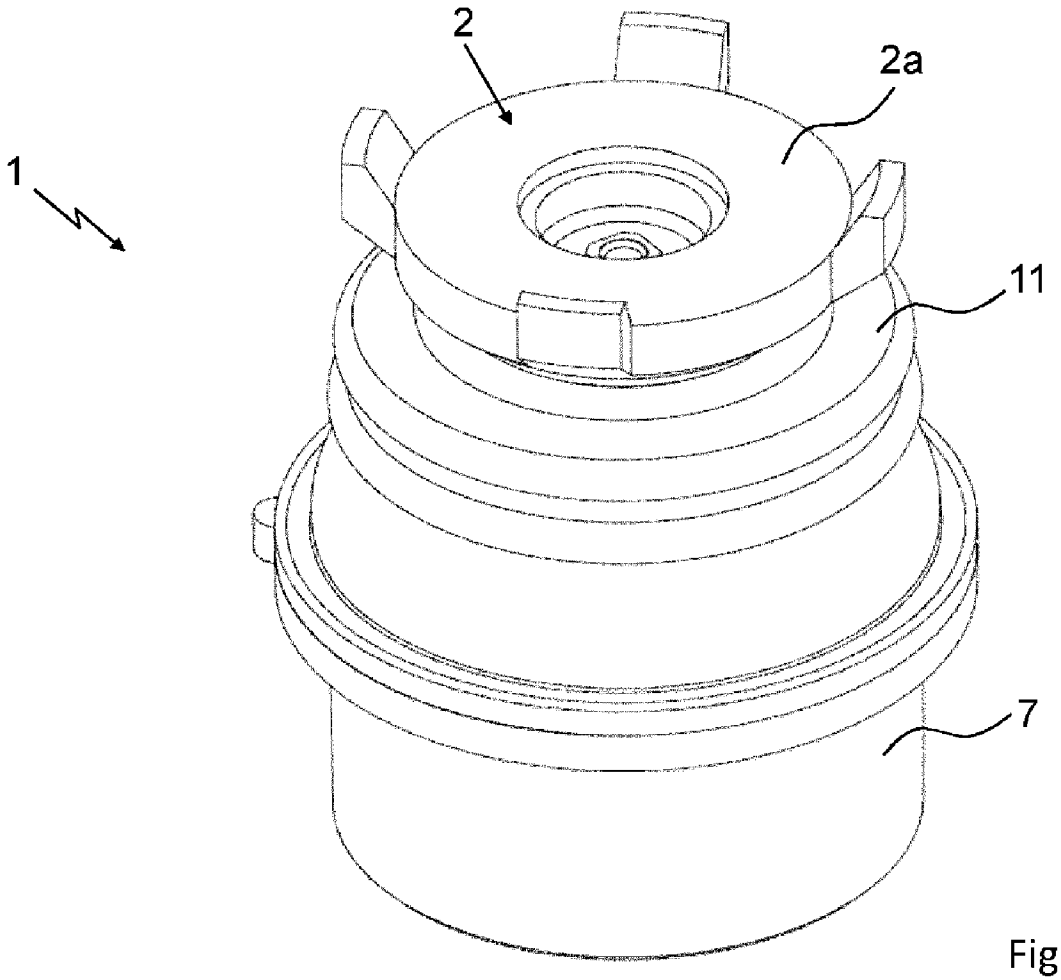
FIG. 1 shows a perspective view of a joystick.

FIG. 1 shows a perspective view of a joystick 1. The joystick 1 can be used as a device for manual actuation on a control switch 107 for operating a hoist or crane (see FIG. 5). For this purpose, the joystick 1 is connected in terms of control technology to the corresponding hoist or crane or to its controller. The joystick 1 is actuated manually by single-finger actuation in order to bring about a movement of the hoist or crane.

The joystick 1 has an optional actuating element 2 for manual actuation. The actuating element 2 defines the direct contact surface 2*a* of the actuating finger, preferably of the thumb, of the operator. In order to improve the ergonomics in the sense of a simple and intuitive operation for the operator for the respective application of the joystick 1, it optionally has concave contours for receiving a fingertip and likewise optionally projecting touch lugs, which represent the movement directions of the hoist or crane, in particular preferred directions, such as the X and Y directions (see FIG. 5).

A housing 7 of the joystick 1 serving as base element is arranged opposite the actuating element 2. In particular, the elements of the joystick 1 described in more detail below are accommodated in the housing 7. In addition, the housing 7 and thus also the joystick 1 can be fastened to a component, for example to a control switch 107 (see FIG. 5).

An elastic protective cover 11 is arranged between the actuating element 2 and the housing 7, by means of which protective cover the further components of the joystick 1 mentioned below are covered and thus protected against environmental influences. This applies to all variants of the device according to the invention.

Figure 2:
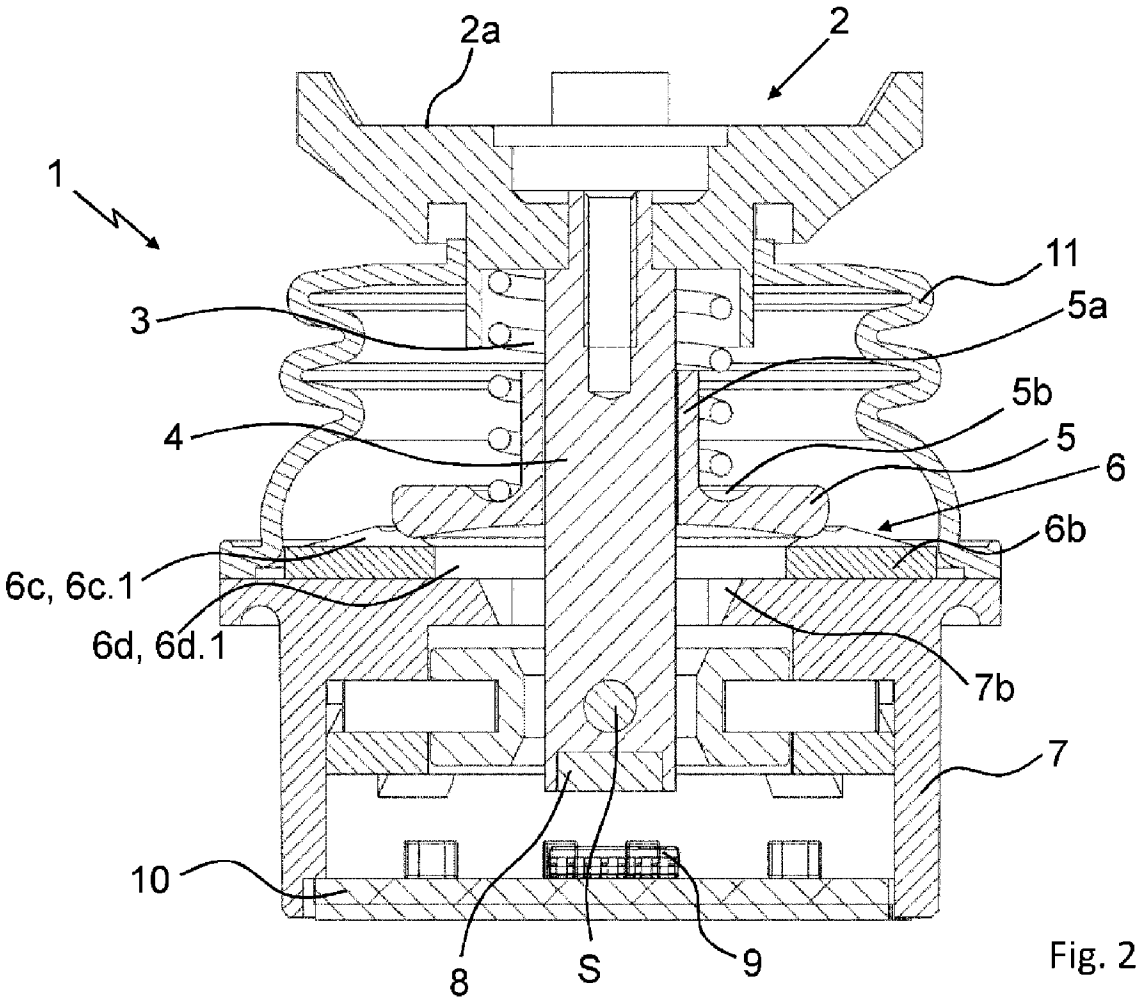
FIG. 2 shows a sectional view of the joystick of FIG. 1.

FIG. 2 shows a sectional view of the joystick 1 of FIG. 1. In addition to the components described in FIG. 1, the joystick 1 comprises the following elements that are relevant to the function of the joystick 1 as a device for manual actuation.

On the base element, which is, for example, designed as a housing 7, a control lever 4 is mounted so as to be pivotable about a pivot point S. By means of a pivot movement, the control lever 4 can be pivoted from an unpivoted base position shown in FIG. 2 into an actuation position (not shown) that is pivoted in relation to the base position. The control lever 4 extends through an opening 7*b* into the housing 7, in whose interior the pivot point S is located. The actuating element 2 is attached to the end of the control lever 4 lying outside the base element or housing 7. A magnet 8 is arranged at the end of the control lever 4 facing away from the actuating element 2 with respect to the pivot point S of the control lever 4 and is connected to the control lever 4 in order to be able to be pivoted together therewith and in particular uniformly therewith.

In addition, a Hall sensor 9 for detecting the pivot movement, preferably the associated pivot direction and/or the associated pivot angle, including its magnitude, of the control lever 4 is arranged in the housing 7. The Hall sensor 9 interacts with the magnet 8 in that it is excited differently by it depending on the pivot movement executed. The magnet 8 and the Hall sensor 9 are part of a sensor system for detecting the pivot movement. An electrical circuit board 10 for generating the control signals is likewise arranged in the housing 7 and is connected to the sensor system, in particular to the Hall sensor 9, in a signal-transmitting manner, and to the controller of the hoist or crane that is arranged outside the joystick 1.

The pivot movement or actuation position of the control lever 4 detected by the Hall sensor 9 is then converted into control signals which bring about a predefined movement of the hoist or crane assigned to the respective pivot direction and/or to the respective pivot angle in particular with respect to direction and/or speed. In the unpivoted base position of the control lever 4, no movement of the hoist or crane is brought about. The control signals required for a movement of the hoist or crane are thus only generated, output and/or processed by the controller when the control lever 4 is in an actuation position.

The control lever 4 is pretensioned in relation to the base element or housing 7 by means of a spring element 3, which takes the form of a helical spring, for example. In an unactuated state, the control lever 4 is held in the unpivoted base position by a pretensioning force generated by the spring element 3 and acting on the control lever 4, and can only be pivoted into a pivoted actuation position by means of a force against the pretensioning force and preferably applied by manual actuation. The pretension applied in this way serves to satisfy safety requirements since this ensures an automatic pivot movement of the control lever 4 back into the unpivoted base position as soon as manual actuation of the control lever 4 is finished.

The spring element 3 is supported at one end via the actuating element 2 on the control lever 4 and at the other end via a guide element 5 and a shifting gate 6 on the housing 7 in order to achieve the pretension in the base position. The spring element 3 is thereby arranged in terms of force flow between the ring-shaped guide element 5 and the control lever 4, in particular between the guide element 5 and the actuating element 2, and extends coaxially therewith in the base position of the control lever 4. The guide element 5 has a cylindrical section 5*a* onto which the spring element 3 is plugged on the outside on a side facing the actuating element 2. A circumferential recess 5*b*, in which the spring element 3 is supported on the guide element 5, is provided around the cylindrical section 5*a* on the guide element 5. The control lever 4 extends through the guide element 5, wherein the guide element 5 and the control lever 4 are arranged coaxially with one another at least in the illustrated base position. The pretension acting on the control lever 4 by the spring element 3 thus takes place indirectly with the guide element 5 and the actuating element 2 interposed in terms of force flow between the base element and the control lever 4, in particular between the shifting gate 6 and the control lever 4.

By means of the guide element 5, the control lever 4 is supported on the shifting gate 6, which, due to its shape, influences the pivot movement of the control lever 4 and is detachably, preferably in a positive-locking manner, connected to the base element or housing 7 and is thus fastened to the latter. The shifting gate 6 is ring-shaped and is thus formed by a ring element 6*b*. The control lever 4 extends into the housing 7 through an opening 6*d* in the shifting gate 6, which in FIGS. 2 and 3 takes the form of an opening 6*d*.1 for multiaxial pivot movements, for example. The housing 7 also has an opening 7*b* for this purpose. The enclosure function of the housing 7 for a part of the control lever 4, the sensor system for detecting the pivot movement with the magnet 8 and the Hall sensor 9, as well as the electrical circuit board 10 is independent of the function of the shifting gate 6 due to the detachable connection to the shifting gate 6. As a result, variants of the joystick 1 with different shifting gates 6 can be realized in a particularly simple manner for different applications of the joystick 1. Only the shifting gate 6 needs to be varied for this purpose.

In the base position of the control lever 4, the control lever is arranged coaxially with the shifting gate 6. During a pivot movement of the control lever 4, the guide element 5 is guided along a characteristic contour 6*c*, 6*c*.1 of the shifting gate 6. Instead of the characteristic contour 6*c*.1, other characteristic contours are also possible (see FIGS. 4*a* to 4*d*). Here, depending on the respective pivot angle of the control lever 4, the guide element 5 is moved counter to or in the direction of the pretensioning force relative to the control lever 4, in particular in parallel to the longitudinal axis thereof, in order to define a shifting characteristic of the joystick 1. The shifting gate 6 hereby defines an actuating force as a shape-related and force-related influence on or restriction of the possible pivot movements of the control lever 4, which actuating force must be applied in order to bring the control lever 4 into a possible pivoted actuation position.

Figure 3:
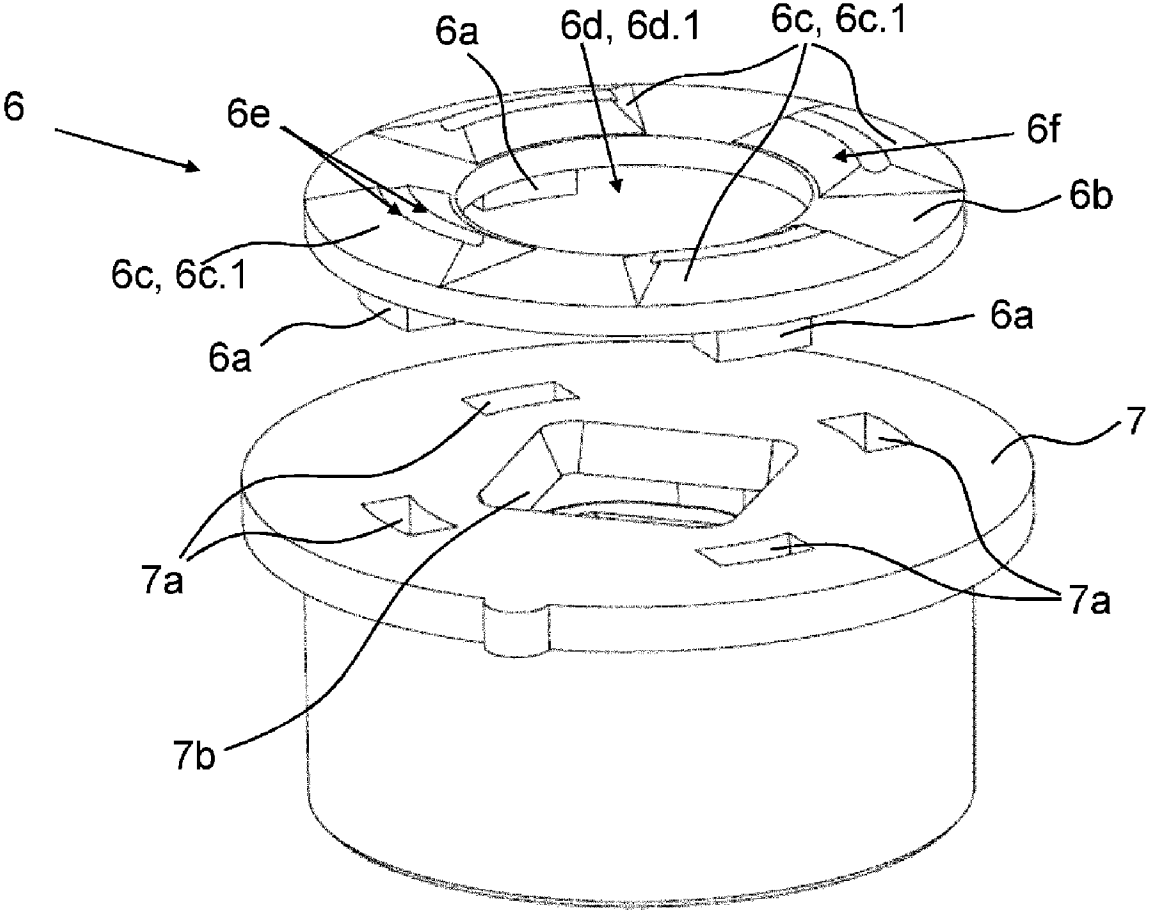
FIG. 3 shows a perspective view of a shifting gate for realizing the two-step shifting characteristic and a housing for the joystick of FIG. 1, FIGS. 4*a* to 4*d* show perspective views of seven exemplary variants of the shifting gate for the joystick of FIG. 1.

FIG. 3 shows a perspective view of a shifting gate 6 for the realization of the two-step shifting characteristic and of the housing 7 used as a base element for the joystick 1 of FIG. 1. For the detachable and positive-locking connection or fastening of the shifting gate 6 to the housing 7, the shifting gate 6 has at least one detent lug 6*a*, in the present case, for example, four detent lugs 6*a*. The detent lugs 6*a* are arranged on the shifting gate 6 on the side of the shifting gate 6 facing away from the characteristic contour 6*c*.1. In order to produce the detachable connection on a side facing the shifting gate 6, the housing 7 accordingly has four receptacles 7*a* for receiving the detent lugs 6*a*. The positioning of the shifting gate 6 within the joystick 1 and relative to its movable components, in particular the control lever 4, is defined by the position of the receptacles 7*a*. The detachable and in particular positive-locking connection produced by the detent lugs 6*a* and the receptacles 7*a* can also be referred to as a snap-in connection.

The opening 7*b* on the housing 7, which serves for the passage of the control lever 4, is also clearly visible.

FIGS. 4*a* to 4*d* show plan views of a total of seven exemplary variants of the shifting gate 6 for the joystick 1 of FIG. 1. All variants are ring-shaped with an opening 6*d*. The differences between the individual variants of the shifting gate 6 which are described below can basically be combined with one another in order to obtain further variants, which are not illustrated.

Figure 4A:
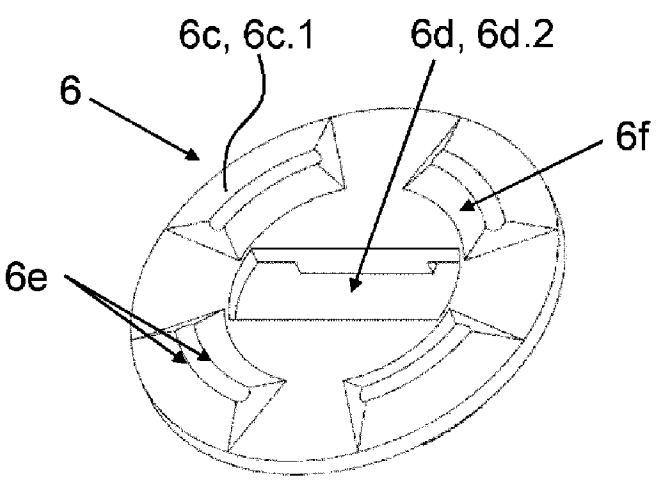
Figure 4A:
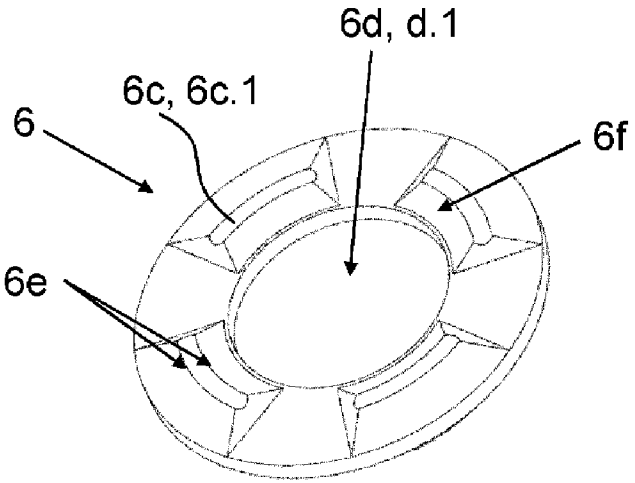
Figure 4B:
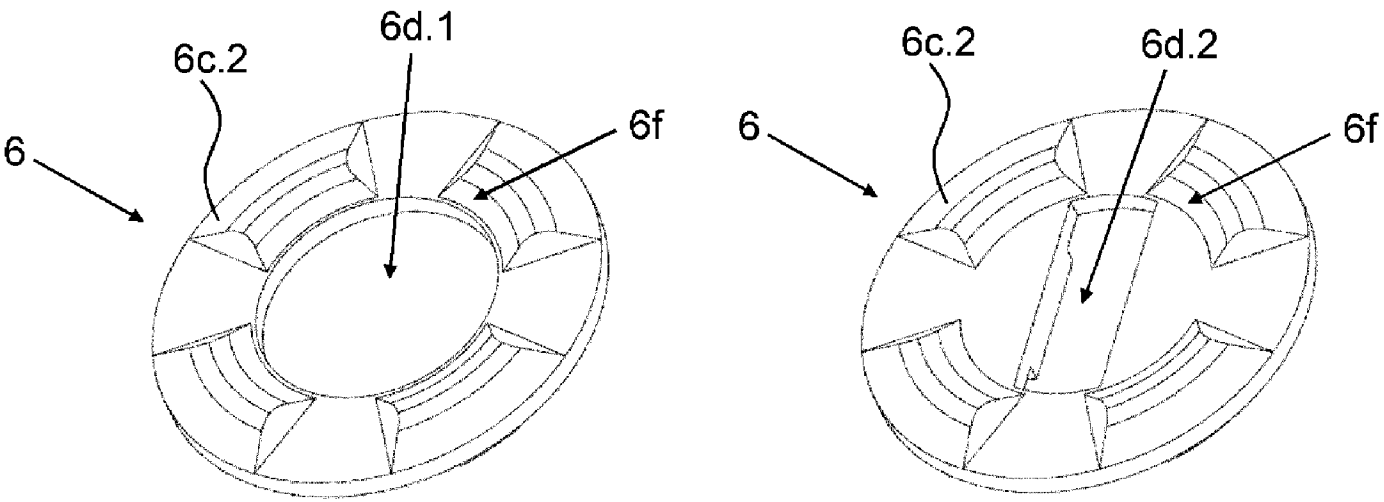
Figure 4C:
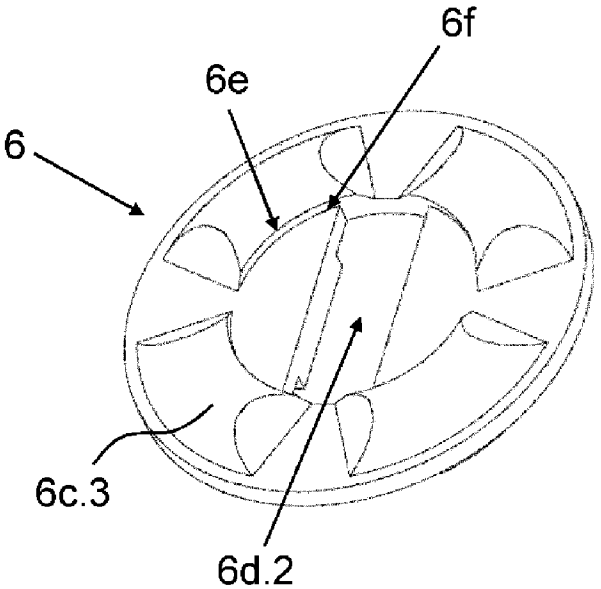
Figure 4C:
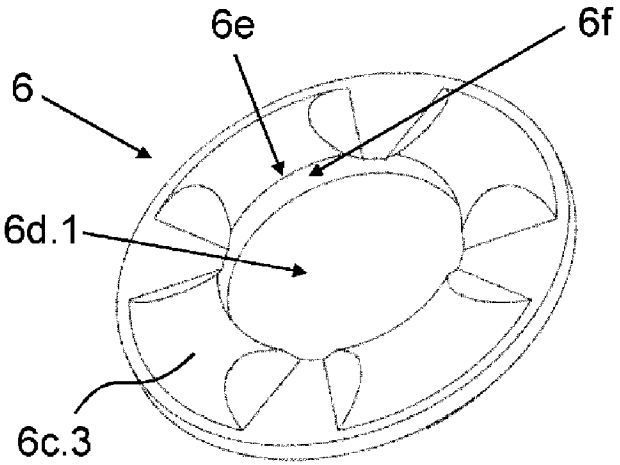

As a shape-related influence on the pivot movement of the control lever 4, the shifting gate 6, depending on the variant, only allows uniaxial or multiaxial pivot movements of the control lever 4, in that due to its shape, it defines a corresponding pivot range. For this purpose, the opening 6*d* is either designed as an opening 6*d*.1 for multiaxial, in particular spherical, pivot movements and in this case is round, preferably circular, or is designed as an opening 6*d*.2 for uniaxial pivot movements, which is then elongate with two edges extending in parallel to one another and linearly in order to limit the pivot range or the possible pivot movements spatially to pivot movements about exactly one axis. In FIGS. 4*a* to 4*c*, the left-hand shifting gate 6 is in each case designed with an opening 6*d*.1 for multiaxial, in particular spherical, pivot movements and the right-hand shifting gate 6 is in each case designed with an opening 6*d*.2 for uniaxial pivot movements. The shifting gate shown in FIG. 4*d* has an opening 6*d*.1 for multiaxial, in particular spherical, pivot movements.

In the case of the variants with multiaxial, in particular spherical, pivot movements, preferred directions can be defined in the above-described sense by the characteristic contour 6*c* being designed as described above with a surface profile, which extends in sections around the respective opening 6*d*, 6*d*.1 or 6*d*.2 in the circumferential direction and thus has the shape of circular ring segments, and with corresponding recesses between the segments of the characteristic contour 6*c* or 6*c*.1 to 6*c*.3. This is the case in all variants shown in FIGS. 4*a* to 4*c*, whereas in the variant of the shifting gate 6 shown in FIG. 4*d*, no preferred direction is defined. Accordingly, the characteristic contour 6*c* or 6*c*.2 there is formed circumferentially not in sections but completely, i.e., continuously and uninterruptedly.

Characteristic contours 6*c* of the shifting gate 6 are also provided as a shape-related influence on the pivot movement of the control lever 4 and have the common features and differences described below in the illustrated variants.

In all variants, the characteristic contour 6*c* is located as a profiled surface of the shifting gate 6 on the side of the shifting gate 6 facing the guide element 5 (not shown in FIGS. 4*a* to 4*d*) and thus opposite the detent lugs 6*a* (hidden in FIGS. 4*a* to 4*d*). In the radial direction, the characteristic contours 6*c* each have a surface profile which rises from the inside to the outside initially in a ramp-like manner and decreases toward the outer edge of the shifting gate 6. In between, the surface profile has exactly one maximum in the radial direction in the case of the single-step characteristic contour 6*c*.3 (FIG. 4*c*) and of the continuous characteristic contour 6*c*.2 (FIGS. 4*b* and 4*d*) but two maxima in the case of the two-step characteristic contour 6*c*.1 (FIG. 4*a*). When the control lever 4 is pivoted starting from the base position, the guide element 5 is guided radially outward in all variants of the shifting gate 6 starting from the innermost section 6*f* of the respective characteristic contour 6*c*.

An edge 6*e* can also be formed between two sections or surface profiles of the characteristic contour 6*c* which are adjacent in the radial direction and have different slopes relative to one another. If the inner of the adjacent sections has a positive slope and the outer of the adjacent sections has a negative slope, the edge 6*e* formed between them defines a maximum (see FIGS. 3 and 4*a*). However, an edge 6*e* may also be designed to define a start detent as described above by both sections adjacent to the edge 6*e* having a positive slope, but the slope of the inner section being steeper than the slope of the outer section (see FIG. 4*c*).

The variants of the shifting gate 6 shown in FIG. 4*a* with in each case a two-step characteristic contour 6*c*.1 have radially from the inside to the outside an initially linearly increasing ramp-shaped surface profile, followed by in each case two maxima, forming an edge 6*e*, which maxima are connected by a concave surface profile. The outer maximum is followed by a surface profile which falls linearly toward the outer edge.

Figure 4D:
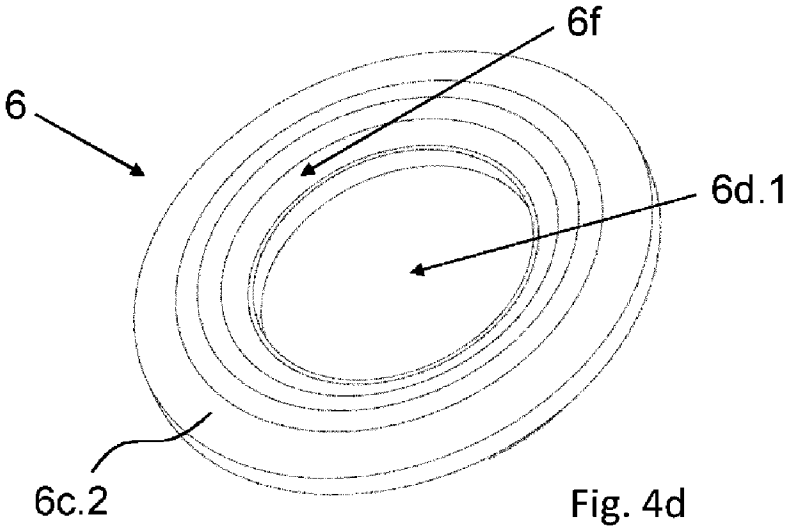

The variants of the shifting gate 6 shown in FIGS. 4*b* and 4*d*, each with a continuous characteristic contour 6*c*.2, have radially from the inside to the outside an initially linearly increasing ramp-shaped surface profile or section 6*f*, which is followed by a convex surface profile, initially increasing and then falling after the maximum, forming the only maximum in each case. The convex surface profile is followed by a surface profile which falls linearly toward the outer edge.

The variants of the shifting gate 6 shown in FIG. 4*c* with in each case a single-step characteristic contour 6*c*.3 have in common with the continuous variants that they likewise have a convex surface profile to form the only maximum. In the case of the continuous characteristic contour 6*c*.2, the slope of the ramp-shaped surface profile which rises from the inside to the outside is less steep than in the case of the single-step characteristic contour 6*c*.3, so that in the case of the continuous characteristic contour 6*c*.2, the maximum lies further outward in the radial direction and is thus reached at a larger pivot angle than in the case of the single-step characteristic contour 6*c*.3.

In the variants shown in FIG. 4*c*, a start detent as described above is also realized by way of example in that the surface profile of the characteristic contour 6*c*.3, which rises in the radial direction from the inside to the outside, has an inner first section 6*f* with a significantly steeper slope than the second section following radially outside. An edge 6*e* is formed between the inner first section 6*f* and the section following on the outside. In the base position, the guide element 5 rests against the first inner section 6*f*.

The illustrated shifting gates 6 with a single-step characteristic contour 6*c*.3 result in a single-step shifting characteristic of the joystick 1, while those with a two-step characteristic contour 6*c*.1 result in a two-step shifting characteristic, and those with a continuous characteristic contour 6*c*.2 result in a continuous shifting characteristic.

In the case of the stepped characteristic contours 6*c*.1 and 6*c*.3, the manually actuated reaching of shifting steps is perceptible; in the case of the continuous characteristic contour 6*c*.2, the manually actuated reaching of the maximum speed is perceptible. Otherwise, the above statements apply in each case to the individual shifting characteristics.

Figure 5:
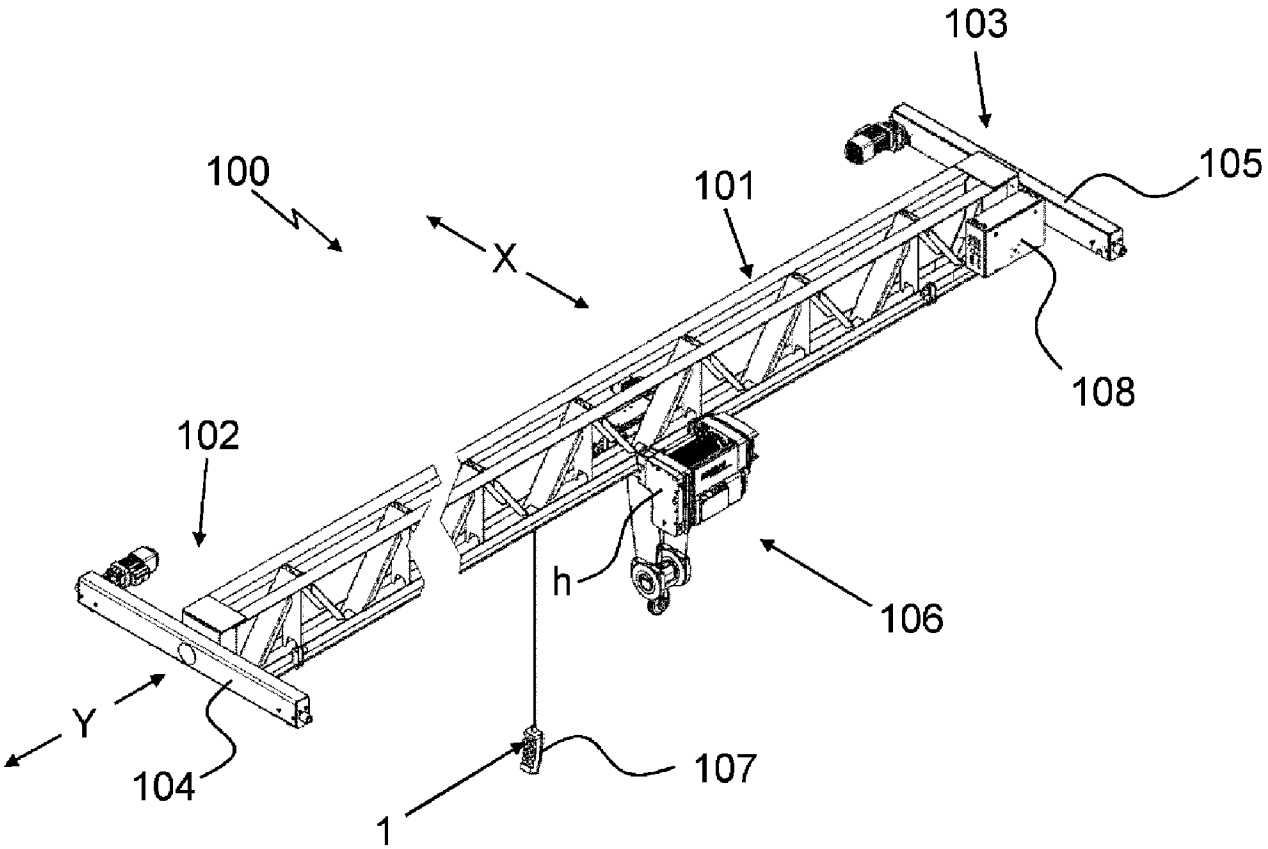
FIG. 5 shows a crane in a perspective view with a control switch which has a joystick according to FIG. 1.
Figure 6:
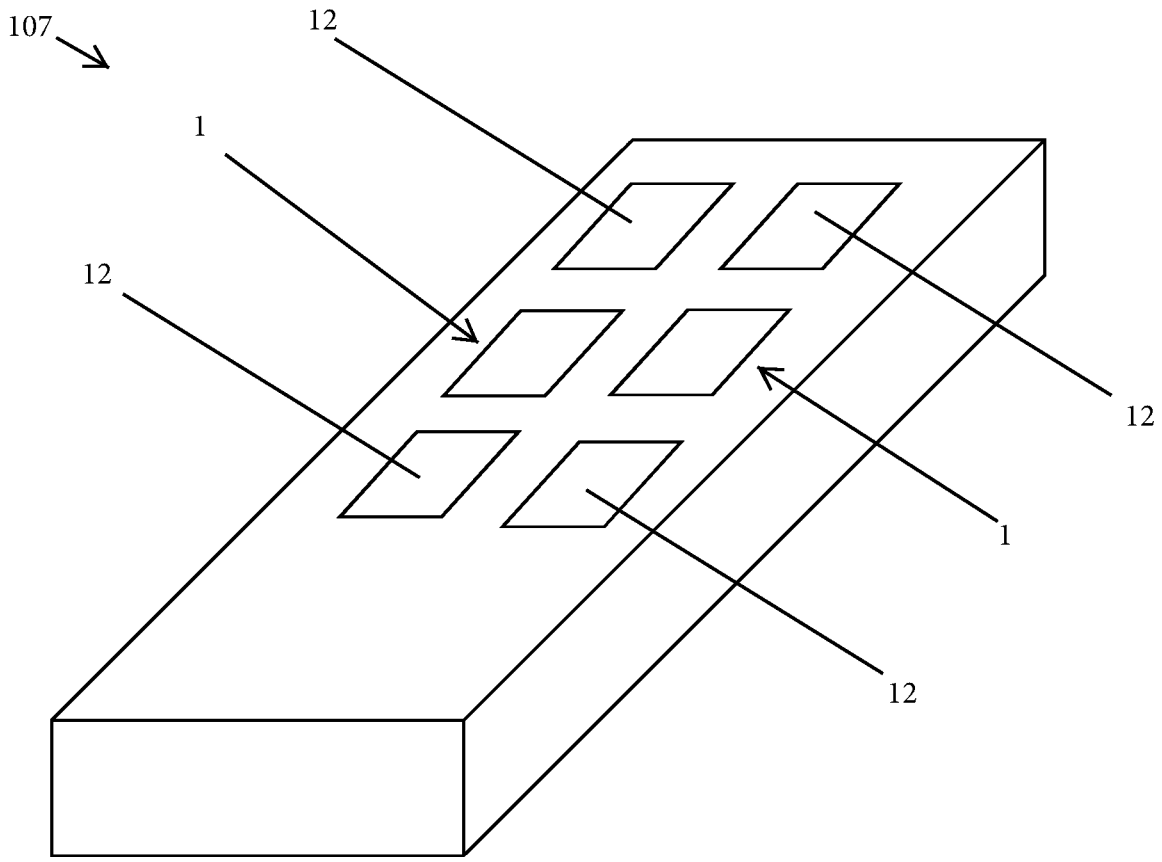

FIG. 5 shows a crane 100 in a perspective view with a control switch 107, which has a joystick 1 according to FIG. 1. As can be seen, the crane 100 takes the exemplary form of a traveling crane in the form of a single-girder bridge crane, which comprises a crane girder 101 movably mounted along a crane track (not shown). The crane girder 101 can be moved, driven by a motor, in particular by an electric motor, in a substantially horizontal direction of crane travel or X direction transversely to its longitudinal axis. For this purpose, running gear 104, 105 driven by an electric motor, for example, is arranged on the opposite ends 102, 103 of the crane girder 101 in each case, being supported in each case on a crane rail of the crane track, which is not shown in detail here. Arranged on the crane girder 101 is a crane trolley 106 with a hoist embodied as a cable pull, for example, which can be moved together with the hoist and its lifting mechanism h, likewise driven by a motor or electric motor, in parallel to the longitudinal axis x of the crane girder 101 in a trolley travel direction or Y direction, driven by a motor, in particular an electric motor, along the crane girder 101.

The operation of the crane 100, i.e., in particular the control of movements and functions of the running gear 104, 105, of the crane trolley 106 and of the lifting mechanism h and of the respective drive, takes place via the control switch 107, which in this example takes the form of a wired pendant control switch, and in particular by manual actuation of its joystick 1 according to the invention. The control switch 107 is connected to the control unit 108 in a signal-transmitting manner. Of course, it is also conceivable for the control switch 107 to be designed as a hand-held radio transmitter.

LIST OF REFERENCE SIGNS

1 Device, here joystick
2 Actuating element
2*a* Contact surface
3 Spring element
4 Control lever
5 Guide element
5*a* Section
5*b* Recess
6 Shifting gate
6*a* Detent lug
6*b* Ring element
6*c* Characteristic contour
6*c*.1 Two-step characteristic contour
6*c*.2 Continuous characteristic contour
6*c*.3 Single-step characteristic contour
6*d* Opening
6*d*.1 Opening for multiaxial pivot movements
6*d*.2 Opening for uniaxial pivot movements
6*e* Edge
6*f* Section
7 Housing
7*a* Receptacle
7*b* Opening
8 Magnet
9 Hall sensor
10 Electrical circuit board
11 Protective cover
100 Crane
101 Crane girder
102 End
103 End
104 Running gear
105 Running gear
106 Crane trolley
107 Control switch
108 Control unit
h Lifting mechanism
S Pivot point
X Crane travel direction
Y Trolley travel direction

The invention claimed is:

1. A control switch for operating a hoist or crane, comprising:

a base element including at least one receptacle;

a control lever configured to pivot relative to the base element between a base position and an actuation position in order to bring about a predefined movement of the hoist or crane;

a pushbutton separated from the control lever and configured to actuate functions of the hoist or crane;

a shifting gate including a characteristic contour on a first surface of the shifting gate, the characteristic contour controlling a resulting force acting on the control lever and thus a shifting characteristic as the control lever is pivoted relative to the base element;

the shifting gate further including at least one flexible detent lug extending from a second surface of the shifting gate, the second surface being opposite from the first surface;

wherein the at least one detent lug of the shifting gate is configured to snap-fit to the at least one receptacle;

a sensor system connected to an electrical circuit board, the sensor system configured to detect pivotal movement of the control lever with the electrical circuit board configured for generating control signals.

2. The control switch according to claim 1, further comprising a spring biasing the control lever to the base position.

3. The control switch according to claim 2, further comprising:

a guide element;

wherein the spring biases the guide element towards the shifting gate such that the guide element is guided along the characteristic contour when the control lever pivots relative to the base element.

4. The control switch according to claim 3, wherein the characteristic contour of the shifting gate is designed such that a continuous shifting characteristic of the device results.

5. The control switch according to claim 3, wherein the guide element is configured to slide along the control lever parallel to a longitudinal axis of the control lever.

6. The control switch according to claim 3, wherein the characteristic contour of the shifting gate is designed with a stepped shifting characteristic and wherein the stepped shifting characteristic comprises either a single-step or a multi-step shifting characteristic.

7. The control switch according to claim 2, wherein the control switch is a wired pendant control switch or a hand-held wireless transmitter.

8. The control switch according to claim 1, wherein the characteristic contour is designed with a continuous shifting characteristic.

9. The control switch according to claim 1, wherein the shifting gate is designed such that the pivot movement of the control lever is limited to a uniaxial pivot movement.

10. The control switch according to claim 9, wherein the shifting gate is frame shaped and wherein the control lever extends through an opening of the shifting gate, and wherein the shape of the opening of the shifting gate is designed such that the uniaxial limitation of the pivot movement results.

11. The control switch according to claim 1, wherein the sensor system is a non-contact sensor system.

12. The control switch according to claim 11, wherein the sensor system is designed to detect the pivot movement according to a magnetic operating principle.

13. The control switch according to claim 11, wherein the sensor system has a magnet and a Hall sensor interacting with the magnet.

14. The control switch according to claim 13, wherein the Hall sensor comprises a 3D Hall sensor.

15. The control switch according to claim 13, wherein the magnet is fastened to the control lever or integrated into the control lever and the Hall sensor is connected to the electrical circuit board.

16. The control switch according to claim 1, wherein the pivot movement comprises a pivot direction and/or a pivot angle of the control lever.

17. The control switch according to claim 1, wherein the shifting gate is designed such that the pivot movement of the control lever is limited to multiaxial pivot movement.

18. The control switch according to claim 17, wherein the shifting gate is frame shaped and wherein the control lever extends through an opening of the shifting gate, and wherein the shape of the opening of the shifting gate is designed such that the multiaxial limitation of the pivot movement results.

* * * * *